US009033316B2

(12) United States Patent
Hansen et al.

(10) Patent No.: US 9,033,316 B2
(45) Date of Patent: May 19, 2015

(54) CLEANING IMPLEMENT WITH MIST GENERATING SYSTEM

(75) Inventors: Eric J. Hansen, Ada, MI (US); Ambreese Hill, Grand Rapids, MI (US); Jeffrey A. Scholten, Ada, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 699 days.

(21) Appl. No.: 13/334,841

(22) Filed: Dec. 22, 2011

(65) Prior Publication Data

US 2012/0168971 A1 Jul. 5, 2012

Related U.S. Application Data

(60) Provisional application No. 61/427,979, filed on Dec. 29, 2010.

(51) Int. Cl.

| | |
|---|---|
| ***B01F 3/04*** | (2006.01) |
| ***A47L 11/40*** | (2006.01) |
| ***A47L 1/09*** | (2006.01) |

(52) U.S. Cl.

CPC ..... *A47L 11/4088* (2013.01); *A47L 1/09* (2013.01); *A47L 11/4086* (2013.01)

(58) Field of Classification Search

CPC .... A47L 1/09; A47L 11/4086; A47L 11/4088
USPC ..... 261/78.2; 15/4, 320, 322
See application file for complete search history.

(56) References Cited

U.S. PATENT DOCUMENTS

| | | | | |
|---|---|---|---|---|
| 595,761 | A | 12/1897 | Brockmann | |
| 1,713,902 | A * | 5/1929 | Hartman | 239/348 |
| 1,764,439 | A | 6/1930 | Fuhrmann | |
| 5,125,126 | A * | 6/1992 | Bonnant | 15/321 |
| 5,443,653 | A * | 8/1995 | Riley | 134/8 |
| 5,464,572 | A | 11/1995 | Bonzi | |
| 5,502,872 | A * | 4/1996 | Chae et al. | 15/320 |
| 5,891,198 | A * | 4/1999 | Pearlstein | 8/158 |
| 6,131,237 | A | 10/2000 | Kasper et al. | |
| 2005/0160553 | A1 | 7/2005 | Gregory | |

(Continued)

FOREIGN PATENT DOCUMENTS

| | | | |
|---|---|---|---|
| EP | 0666053 | A1 | 8/1995 |
| EP | 1 629 759 | A1 * | 3/2006 |
| GB | 2334668 | A | 1/1999 |

(Continued)

OTHER PUBLICATIONS

Roberto Trimarchi, European Search Report, Nov. 13, 2013, Munich, 2 pages.

*Primary Examiner* — Charles Bushey
(74) *Attorney, Agent, or Firm* — McGarry Bair PC

(57) ABSTRACT

A mist generating system for a cleaning implement is adapted to generate a finely atomized liquid mist for suppressing dust, allergens, and other airborne particulates. The mist generating system can be adapted to fit many cleaning implements such as vacuum cleaners, wet extraction cleaners, floor mops, and dusters to suppress airborne dust and particulates generated during operation and the cleaning process.

13 Claims, 9 Drawing Sheets

(56) References Cited

U.S. PATENT DOCUMENTS

| | | | | |
|---|---|---|---|---|
| 2006/0185113 | A1 | 8/2006 | Kloeppel et al. | |
| 2006/0225242 | A1 | 10/2006 | Oh et al. | |
| 2010/0037915 | A1 | 2/2010 | Johnson et al. | |
| 2012/0117750 | A1 * | 5/2012 | Orubor | 15/320 |

FOREIGN PATENT DOCUMENTS

| | | | |
|---|---|---|---|
| JP | 2005185414 | A | 7/2005 |
| JP | 2006102008 | A | 4/2006 |
| WO | 2007063452 | A2 | 6/2007 |
| WO | 2011002032 | A1 | 6/2011 |

* cited by examiner

CLEANING IMPLEMENT WITH MIST GENERATING SYSTEM

CROSS REFERENCE TO RELATED APPLICATIONS

This application claims the benefit of U.S. Provisional Patent Application No. 61/427,979, filed Dec. 29, 2010, which is incorporated herein by reference in its entirety.

BACKGROUND OF THE INVENTION

Conventional vacuum cleaners can comprise a rotatably-driven agitator for agitating debris on a surface to be cleaned. The agitator can be rotated at high speed so that the debris is released from the surface and more easily ingested into the vacuum cleaner. However, agitating the surface to be cleaned, such as carpet for example, tends to disturb dust and debris trapped on carpet fibers. Thus, the agitation process can generate airborne particulates such as dust particles, carpet fuzz, pet dander, and other allergens that can pollute the ambient air surrounding the vacuum cleaner. The small, lightweight particulates can float upwardly from the surface to be cleaned and can be inhaled by an operator. Likewise, dusting with a conventional dust mop, flat mop, or hand duster can also disturb dust particles on the surface to be cleaned, thus causing the particulates to float upwardly and pollute the atmosphere. In some cases, operators can be sensitive to these airborne particulates—especially those persons having allergies or other respiratory sensitivities.

Moreover, in addition to generating airborne particulates, the vacuum cleaning process can also generate malodors. A conventional vacuum cleaner comprises a suction source for generating a working airflow through a working airpath. The vacuum cleaner is adapted to entrain dust, debris, and allergens through a suction nozzle into the working airflow. Particles entrained in the working airflow are separated and collected in a dirt cup. Separated exhaust air is discharged through the suction source and one or more optional downstream filters. Malodors can be released when the cleaning surface is disturbed. Additionally, the working airflow can release malodors as the air flows through the system, impinging on various obstructions, and as it is exhausted into ambient atmosphere. Excessive malodors can create an unpleasant user-experience for an operator.

SUMMARY OF THE INVENTION

A cleaning implement according to one embodiment of the invention comprises a housing for movement over a surface to be cleaned and a mist generating system mounted to the housing. The mist generating system can comprise a tank for holding a supply of liquid, the tank having a tank inlet and a first tank outlet, an atomizer nozzle in fluid communication with the first outlet and having a nozzle outlet for spraying a mist, and an air pump in fluid communication with the tank inlet for supplying air to the tank, wherein, when the air pump has pressurized the supply of liquid in the tank, liquid is provided to the atomizer nozzle through the first tank outlet.

DETAILED DESCRIPTION

The present invention relates to a modular mist generating system for a cleaning device. The modular mist generating system can be adapted to generate a finely atomized liquid mist for suppressing dust, allergens, and other airborne particulates. Moreover, the modular mist generating system can be adapted to deodorize the atmosphere surrounding the modular system and/or to apply a treatment to a surface to be cleaned near the modular system. The modular mist generating system can be adapted to fit many cleaning products such as vacuum cleaners, extraction cleaners, dust mops, and hand tools, for example, to suppress airborne dust and particulates generated during operation. The atomized liquid mist can comprise a composition adapted to deodorize and neutralize odors on the surface to be cleaned, or to agglomerate dust. Alternatively, the mist composition can be configured to apply a treatment to the cleaning surface such as a detergent to clean the surface, a sanitizing agent, a coalescing or flocculating agent to agglomerate and suppress airborne dust, or miticide to kill dust mites on the surface to be cleaned, for example.

Figure 1:
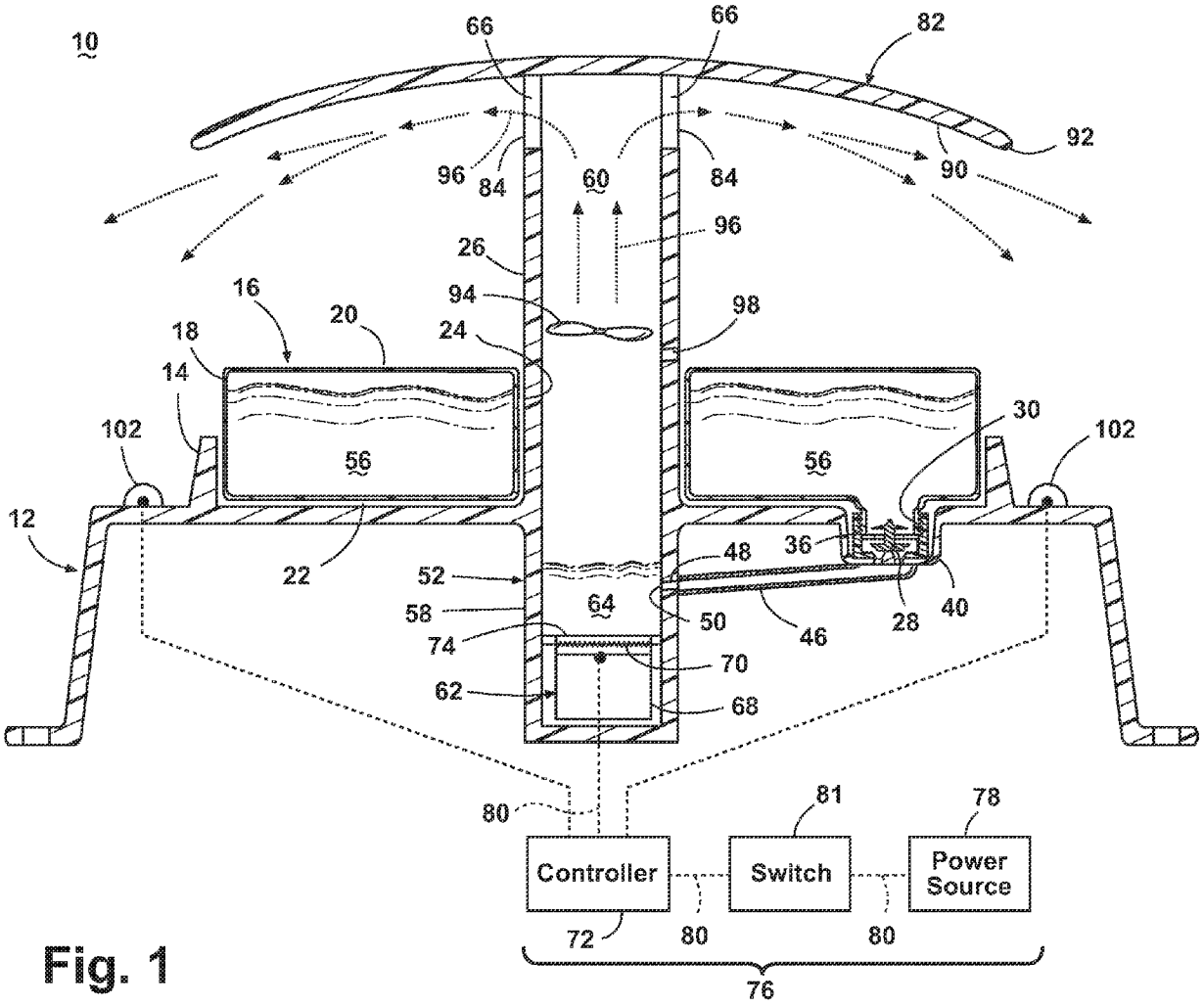
FIG. 1 is a schematic view of a modular mist generating system according to a first embodiment of the invention.

FIG. 1 is a schematic view of a modular mist generating system 10 according to a first embodiment of the invention. The mist generating system 10 comprises a housing 12 with a mounting feature such as a recessed pocket 14 formed in a top wall thereof for selectively receiving a refillable liquid supply tank 16. The tank 16 can be molded out of transparent thermoplastic material and comprises a generally circular shape with a peripheral sidewall 18 and an enclosed top wall 20 and bottom wall 22. The tank 16 can further comprise a cylindrical opening 24 at the center thereof that is configured to surround a raised cylindrical rib 26 protruding upwardly from the center of the pocket 14.

A valve mechanism 28 for controlling the flow of liquid from the tank 16 can be provided and is selectively received within an outlet defined by a threaded neck 30 on the bottom wall 22 of the tank 16 and retained thereon by a retention cap 36. The pocket 14 can comprise a valve seat 40 that couples with the valve mechanism 28. The valve mechanism 28 can comprise a conventional plunger valve in which a spring is adapted to bias a valve member to a closed position to prevent liquid 56 held in the tank 16 from exiting. However, when the tank 16 is seated within the pocket 14, the valve member is deflected to an open position in which liquid can flow out of the tank 16 by gravity. When the tank 16 is removed from the pocket 14 and inverted, the retention cap 36 can be unscrewed and the valve 28 removed to fill the inverted tank 16 by pouring liquid through the opening defined by the threaded neck 30.

A fluid conduit 46 is fluidly connected between the valve seat 40 and an outlet barb 48. The outlet barb 48 comprises a small outlet orifice 50 that is adapted to control the flow of liquid from the tank 16 into an atomizing chamber 52, which can be recessed into a top wall of the housing 12 and further defined at least in part by the cylindrical rib 26 that protrudes upwardly therefrom.

The liquid 56 held in the tank 16 can comprise water. Alternatively, the liquid can comprise a composition containing water and one or more additives such as fragrance, deodorizing agents, odor neutralizing agents, cleaning detergents comprising surfactants or peroxygen components, various surface treatments such as miticide, sanitizing agents, surfactants, or coalescing or flocculating agents for suppressing and agglomerating dust, for example. The following examples are for exemplary purposes only and are not to be construed as limiting the invention disclosed herein: a suitable odor neutralizing agent can comprise undecylenic acid; suitable sanitizing agents can comprise EPA-exempted natural disinfectants such as botanical sanitizers that comprise one or more essential oils such as thyme, peppermint, cinnamon, lemon grass, clove, patchouli, eucalyptus, or other natural oils; suitable surfactants can comprise nonionic, anionic, or cationic surfactants commonly known in the art; and a suitable coalescing or flocculating agent can comprise a liquid polymer or other liquid dispensable agent that is adapted to form bonds between aggregate dust particles to agglomerate dust and reduce airborne particulates. In addition, the sanitizing agent can comprise one of: quaternary ammonium compounds (quats), such as Dialkyl quats, Dialkyl blend quats, single-chain quats and dual chain quats, hydrogen peroxide or hydrogen peroxide derivatives, or colloidal particles with disinfecting or sanitizing properties, including silver and/or copper. A suitable miticide agent can comprise benzyl benzoate as further disclosed in U.S. Pat. No. 6,376,542 to Hansen et al., which is incorporated herein by reference in its entirety. These potential additives can be mixed into the composition and dispersed in a water carrier.

The composition can be supplied in premixed form and poured directly into the tank 16, or the additive can be mixed with water in the tank 16. Alternatively, the mist generating system 10 can comprise an auxiliary tank (not shown) that is adapted to hold the liquid additive and is fluidly connected to an associated mixing system (not shown) that is configured to mix the additive from the auxiliary tank with water from the tank 16 at a desired mix ratio prior to dispensing the mixture into the atomizing chamber 52 through the valve 28. While not shown, the tank 16 can additionally comprise a filter for filtering the liquid 56 prior to discharging it through the valve 28.

The vertically-oriented atomizing chamber 52 comprises a well chamber 58 in a lower portion and a vapor chamber 60 in an upper portion thereof. A cylindrical mist generator 62 is sealingly mounted within a lower portion of the well chamber 58, coaxial with the atomizing chamber 52. The top of the mist generator 62 is spaced below the outlet barb 48 to accommodate a liquid reservoir 64 formed between the top surface of the mist generator 62 and the outlet barb 48. The liquid reservoir 64 receives liquid from the tank 16 through the outlet barb 48 of the fluid conduit 46. The top of the mist generator 62 can lie along a horizontal plane, perpendicular to the sidewalls of the atomizing chamber 52, or alternatively, it can be angled with respect to the sidewalls of the atomizing chamber 52. The liquid reservoir 64 is adapted to hold liquid from the tank 16 at a level at a level co-planar with the outlet barb 48 as will be described hereinafter. The vapor chamber 60 extends upwardly from the top of the liquid reservoir 64 to one or more mist outlet apertures 66 at the top opening of the cylindrical rib 26, which is open to atmosphere. Hence, when the liquid volume inside the tank 16 is greater than or equal to the liquid volume held in the reservoir 64, a hydrostatic equilibrium is created that maintains the liquid level in the reservoir 64 at a constant level below the barb 48. Downward atmospheric pressure on the liquid within the reservoir 64 counterbalances the downward pressure of the liquid and negative head space pressure inside the tank 16 thereby resulting in hydrostatic equilibrium.

In one embodiment, the mist generator 62 can comprise a transducer 68 further comprising a disk-shaped piezoelectric element 70 that is adapted to convert signals received from an electronic controller 72 into mechanical vibrations. Although a single transducer is shown in the figures, it is contemplated that the invention can comprise a plurality of transducers. A flexible, impermeable membrane 74, commonly referred to as a wear plate, can be bonded to the piezoelectric element 70 at the top of the transducer 68 to protect the piezoelectric element 70 from wear and moisture damage. The membrane 74 is adapted for direct exposure to liquid in the reservoir 64. The diameter of the piezoelectric element 70 can be approximately 15 mm to 75 mm; however, the size can be adjusted depending on the volume of the liquid reservoir 64 to be atomized and dimensions of the well chamber 58. The transducer 68 is operably connected to a control circuit 76 comprising the electronic controller 72 that is operably connected to a power source 78 via conductor wires 80 and a power switch 81. The electronic controller 72 can comprise a conventional PCB assembly configured to provide output signals to the piezoelectric element 70. The power switch 81 can be remote from the modular mist generating system 10, or can be mounted to part of the system 10, such as the housing 12. The power source 78 can comprise alternating current (AC) from a residential power outlet, a voltage tap circuit connected to field windings of a conventional electrical motor assembly, or direct current (DC) power that is either converted by a transformer or supplied by a battery pack, for example. The piezoelectric element 70 can be adapted to vibrate within a frequency range of 5.0 kHz-2.5 MHz and preferably at 1.7 MHz to convert low viscosity liquid into fine mist particles with diameters ranging from 10 microns (μ) to 100 microns (μ). The piezoelectric element can be energized continuously, or can optionally be intermittently energized to vary the mist flow rate. For example, the duty cycle of the piezoelectric element can comprise be adjustable to selectively vary the mist flow rate. Although the description herein relates to a piezoelectric element positioned below a standing well chamber, alternate configurations are within the scope of the invention. For example, the piezoelectric element 70 could comprise a perforated disk-shaped piezoelectric element positioned at the top of a standing well chamber as is known in the piezoelectric atomizer field of art.

A dome-shaped guide shroud 82 can be mounted above the mist outlet aperture(s) 66. The shroud 82 can be supported by one or more mounting legs 84 that extend upwardly from the rib 26. The guide shroud 82 can be removable from the mounting leg(s) 84 for access, removal, and installation of the tank 16. Alternatively, the mounting legs 84 can extend upwardly from elsewhere on the housing 12 or from the tank 16, or the guide shroud 82 can be pivotally mounted to the housing 12 via a trunion leg (not shown) that is pivotally connected to the housing 12 via a pin joint (not shown), which permits the guide shroud 82 to be pivoted rearwardly for user access, removal, and installation of the tank 16. The guide shroud 82 comprises an arcuate bottom surface 90 that extends outwardly and downwardly from the center of the shroud 82 towards an outer edge 92 thereof and is adapted to guide atomized mist 96 floating through outlet aperture 66 carried by convective forces along an outward and downward trajectory, away from the housing 12.

Optionally, as shown in FIG. 1, the modular mist generating system 10 can comprise a fan 94 adapted to generate an air flow to blow atomized mist 96 along a desired trajectory. The fan 94 can be driven by an electric motor or an air turbine (not shown) as is commonly known in the art. The fan 94 can be located within the vapor chamber 60 to pull the atomized mist 96 upwardly and blow it against the bottom surface 90 of the shroud 82 and direct it through the aperture 66. Air can be ported into the vapor chamber 60 through an inlet 98 located below the fan 94. Alternatively, the fan 94 can be positioned above or outside the mist outlet aperture 66 to pull the atomized mist 96 through the aperture 66. In one configuration, the inlet 98 can be oriented along an upward spiral path to impart an upward swirling motion to the atomized mist 96. Alternatively, the air flow can enter the vapor chamber 60 above the outlet aperture 66 through at least one inlet 98 angled downwardly and oriented to blow the atomized mist along a downward and outward trajectory towards the outer edge 92 of the shroud 82 and housing 12.

The housing 12 of the modular mist generating system 10 can further comprise at least one light-emitting diode (LED) 102 mounted for illuminating the atomized mist droplets 96 that are expelled from the atomizing chamber 52. The LED 102 can be electrically connected to the power source 78 via the control circuit 76 and configured to be energized when a user turns the power switch 81 "ON" to energize the mist generator 62. The LED 102 can be mounted at a variety of locations on the housing 12 to provide the desired illumination effect. For example, in the illustrated embodiment, two LEDs 102 can be mounted to the housing 12 adjacent to the tank 16 and outside the pocket 14 and configured to direct light upwardly to illuminate atomized mist 96 emerging from the outer edge 92 of the shroud 82. Alternatively, LED(s) 102 can be positioned in the pocket 14 underneath the transparent tank 16, inside the atomizing chamber 52, or on the shroud 82.

In operation, a user fills the liquid tank 16 through the opening defined by the threaded neck 30 after first removing the retention cap 36 and valve mechanism 28. The user then reinstalls the valve mechanism 28 and inserts the tank 16 into the recessed pocket 14 on the housing 12 by sliding the cylindrical opening 24 around the raised cylindrical rib 26 protruding from the housing 12 and seating the valve mechanism 28 within the valve seat 40, which moves the valve mechanism to a position in which liquid can flow out of the tank 16 by gravity. The liquid flows into the well chamber 58 via the fluid conduit 46 and outlet barb 48, and fills the well chamber 58 above the piezoelectric element 70 of the transducer 68 until it reaches a level co-planar with the outlet barb 48. Downward atmospheric pressure on the liquid within the reservoir 64 counterbalances the downward pressure of the liquid and negative head space pressure inside the tank 16, thereby, resulting in hydrostatic equilibrium that maintains the liquid level inside the reservoir 64 at a relatively constant level, substantially coplanar with the outlet barb 48.

Next, upon connecting the modular mist generating system 10 to a power supply, such as a residential power outlet or battery pack, a user can selectively energize the mist generator 62 by actuating the power switch 81, which, in turn energizes the control circuit 76 and controller 72. The electronic controller 72 sends electrical signals via conductor wires 80 to the piezoelectric element 70 mounted within the transducer 68. The piezoelectric element 70 and membrane 74 vibrate at a predetermined frequency beneath the liquid standing in the reservoir 64. The vibration generates waves that push upwardly through the standing liquid. As the waves push through the liquid, they generate a small fountain that releases atomized liquid mist droplets 96 off the surface thereof into the vapor chamber 60. The atomized mist droplets 96 float upwardly through the vapor chamber 60 by convective forces and flow through the outlet aperture 66. The arcuate bottom surface 90 of the shroud 82 guides the mist droplets downwardly and outwardly towards the outer edge 92 thereof. The mist droplets continue on a downward and outward trajectory toward the perimeter of the housing 12. If the modular mist generating system 10 comprises the fan 94, the air flow generated by the fan 94 enters the vapor chamber 60 through the inlet 98 and blows the mist droplets 96 through the outlet aperture 66 and along the desired trajectory towards the periphery of the housing 12. The LEDs 102, which are activated when the user engages the power switch 81 to the "ON" position, illuminate the mist droplets 96 as they move along the trajectory.

Some of the atomized mist droplets 96 expelled from the modular mist generating system 10 collide with airborne dust particles. The atomized mist wets the dust particles, which increases the mass of the dust particles and drops the wetted particles to the ground. Accordingly, the modular mist generating system 10 reduces the quantity of airborne particulates in the vicinity of the modular mist generating system. As the atomized mist droplets continue along their trajectory, they eventually fall out of the atmosphere to the cleaning surface. Accordingly, when the liquid 56 contains various additives as described above, such as detergents, odor-neutralizers, sanitizers, detergents, or other treatments like miticide or flocculating agents, for example, the modular mist generating system 10 can be used to apply those compositions to the surface to impart the desired treatment or properties thereon. However, because the compositions are applied to the surface as atomized mist, the surface does not become overly wet or saturated as compared to conventional liquid sprays that have much larger droplets sizes. For example, the diameter of the atomized mist 96 expelled by the mist generating system 10 can be approximately 10 microns to 100 microns, while the diameter of droplets from the liquid spray from an extraction cleaner are generally greater than 100 microns.

Figure 2:
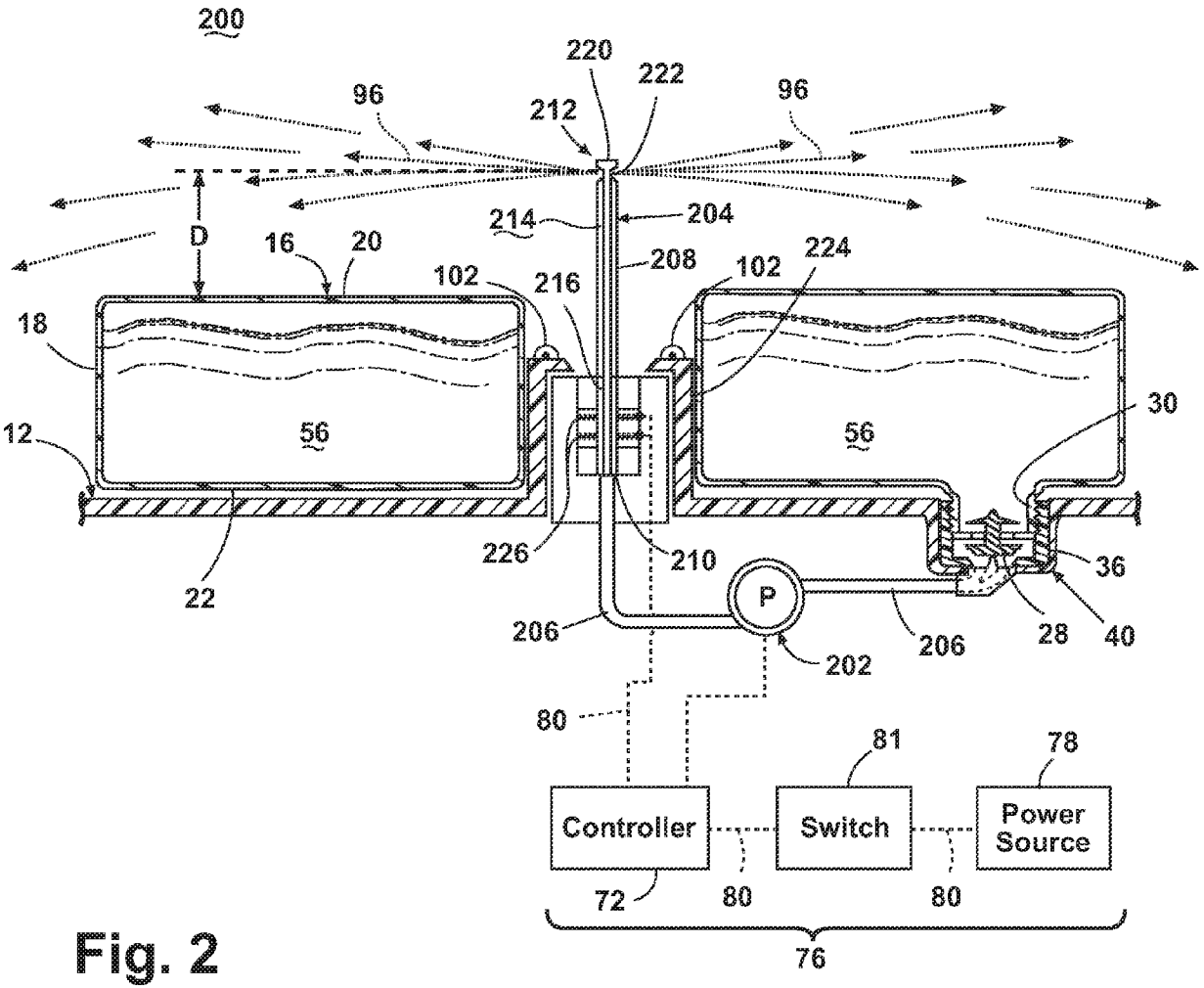
FIG. 2 is a schematic view of a modular mist generating system according to a second embodiment of the invention.

FIG. 2 shows a modular mist generating system 200 according to a second embodiment of the invention where like features are indicated with the same reference numeral symbol. The mist generating system 200 is substantially identical to the mist generating system 10 shown in FIG. 1, except that the valve seat 40 is fluidly connected to a pump 202 and a downstream atomizing nozzle 204 that are fluidly connected by tubing 206 that is sealingly secured therebetween. The pump 202 can comprise a conventional centrifugal or solenoid design as is commonly known in the art.

The atomizing nozzle 204 comprises an elongate, cylindrical, piezoelectric transducer probe 208, a liquid inlet 210 and a nozzle outlet 212 that is fluidly connected to the liquid inlet 210 via a hollow chamber 214 extending along a longitudinal axis. The inlet 210 is fluidly connected to the pump 202 via the tubing 206. A liquid flow path is thus formed along the hollow chamber 214 of the nozzle 204, from the inlet 210 to the nozzle outlet 212. The nozzle outlet 212 can comprise at least one outlet orifice 222. The outlet orifice 222 can be coaxial with the liquid flow path, or, alternatively, the orifice 222 can be oriented along an axis divergent from the hollow chamber 214. For example, as shown in FIG. 2, the outlet orifice 222 can be formed by a plurality of small holes drilled into the nozzle 204 perpendicularly and radially to the hollow chamber 214.

The probe 208 extends within the nozzle 204 through the chamber 214, and includes a proximal end forming a probe tip 220 and a distal end 216. The probe tip 220 can be positioned at the nozzle outlet 212 adjacent the orifice 222 can further comprise a convex shape for generating a desired mist spray pattern and mist trajectory. The nozzle outlet 212 design can influence the trajectory, spray pattern, and coverage area of the atomized mist. For example, a coaxial outlet orifice 222 combined with a convex probe tip 220 can generate a dome or umbrella-shaped mist trajectory whereas a radial nozzle outlet orifice 222 can generate a predominantly horizontal, radial mist trajectory. The probe is preferably constructed of rigid, corrosion-resistant material such as stainless steel or titanium, for example.

The distal end 216 of the probe 208 is housed within a cylindrical base portion 224 of the housing 12 that also houses one or more piezoelectric elements 226 in electronic register with the probe 208. The piezoelectric elements 226 are operably connected to the controller 72 and are configured to convert electrical signals from the controller 72 into mechanical vibration that is, in turn, transmitted to the probe 208 to atomize liquid from the tank 16 that is propelled through the chamber 214 by the pump 202.

The atomizing nozzle 204 is oriented vertically with respect to the housing 12 so that the longitudinal axis of the chamber 214 is generally orthogonal to the substantially horizontal housing 12. As shown in FIG. 2, the probe 208 protrudes upwardly from the housing 12 so the nozzle outlet 212 is located at a predetermined vertical distance D above the top wall 20 of the tank 16 when the tank 16 is seated on the housing 12. The vertical distance D can be selected to attain a desired mist trajectory and spray pattern. Several variables can influence the selection of the vertical distance D, including the nozzle outlet configuration, tank dimensions, housing dimensions, transducer oscillation frequency, and pump flow rate, for example. The previous description is for exemplary purposes and is not to be construed as limiting the invention to one specific atomizing nozzle mounting configuration. For example, the atomizing nozzle 204 can be inverted, with the nozzle outlet 212 pointing downwardly. Accordingly, the atomizing nozzle 204 can be mounted to a support structure extending above the housing 12 and adapted to space the nozzle outlet 212 above the housing 12 and tank 16.

In operation, a user prepares the modular mist generating system 200 for use by filling the liquid tank 16 and seating it on the housing 12. The valve mechanism 28 engages the valve seat 40, thereby fluidly connecting the tank 16 to the pump assembly 202 and atomizing nozzle 204 via the tubing 206. Next, a user connects the system to the power source 78 and actuates the remote power switch 81 to energize the controller 72 and the pump 202. The controller 72 sends electronic signals to the piezoelectric elements 226 and the piezoelectric elements 226 convert electrical signals from the controller 72 into mechanical vibration that is transmitted to the probe 208.

The pump 202 propels liquid from the tank 16 into the inlet 210 via liquid supply tubing 206 that fluidly connects the components. The liquid is pumped through the chamber 214 to the nozzle outlet 212. As the liquid reaches the outlet orifice 222, the ultrasonic vibrations atomize the liquid into ultra fine mist droplets and distribute them into the surrounding atmosphere along a predetermined mist trajectory. The radial holes of the outlet orifice 222 distribute the mist droplets 96 in a disk shaped pattern that follows a generally horizontal and slightly downward trajectory towards the perimeter of the housing 12 as illustrated in FIG. 2.

Although the atomizing nozzle 204 disclosed herein comprises an elongate, cylindrical, hollow transducer probe 208 that forms liquid flow path 218 therethrough, this is for exemplary purposes and additional configurations are within the scope of the invention. For example, the transducer probe 208 can be a solid, elongate member and the liquid flow path can be formed through a liquid delivery tube located adjacent to and along the length of the probe. The liquid delivery tube can be adapted to distribute liquid onto the probe tip. A more thorough description of this configuration can be found in U.S. Pat. No. 4,085,893, which is incorporated herein by reference in its entirety.

Figure 3:
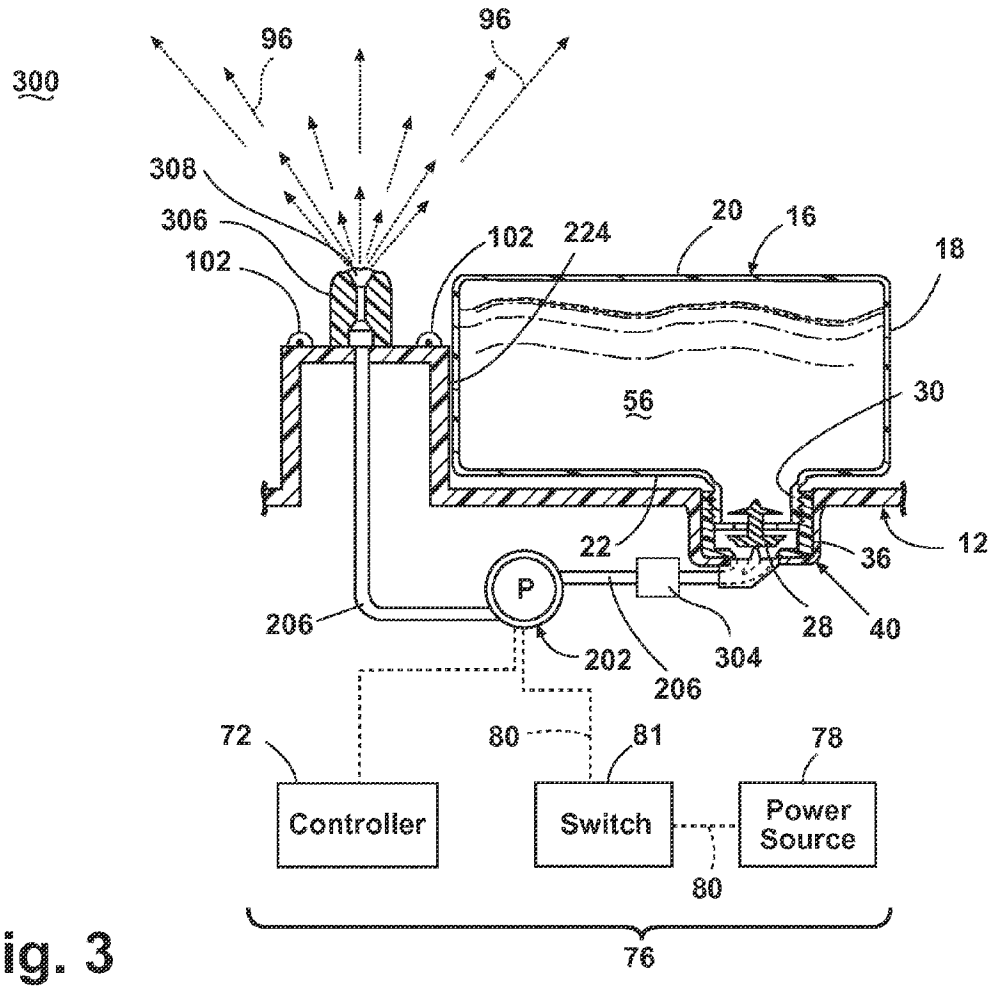
FIG. 3 is a schematic view of a modular mist generating system according to a third embodiment of the invention.

FIG. 3 is a schematic view of a modular mist generating system 300 according to a third embodiment of the invention where like features are indicated with the same reference numerals. The mist generating system 300 is similar to the mist generating system 200 shown in FIG. 2, except that a filter 304 is positioned in-line between the pump 202 and an atomizing nozzle 306. Flexible tubing segments 206 are sealingly connected between the aforementioned components to form a liquid flow path, which includes the filter 304, therethrough. Furthermore, an atomizing nozzle 306 is employed in place of atomizing nozzle 204, and can comprise a low pressure misting nozzle adapted to distribute an atomized liquid mist for suppressing dust, deodorizing a cleaning surface, or applying an atomized composition to a surface to be cleaned. The nozzle 306 can be fixed in an upward orientation relative to the housing as shown, or alternatively, the nozzle position can be adjustable relative to the housing, or it can be oriented transversely or towards the surface to be cleaned. The nozzle 306 can comprise a variety of commercially available misting nozzles, such as impact nozzles, low pressure mist nozzles, and plastic mist nozzles currently available from http://www.i-spraynozzie.com, for example. The nozzle 306 can comprise an outlet orifice 308 with a diameter ranging from 0.1 mm to 0.5 mm. At least one commonly known check valve (not shown) can be incorporated into the tubing 206 between the nozzle 306 and pump 202 to prevent liquid leakage through the outlet orifice 308 when the pressure in the tubing 206 is below a predetermined threshold. Furthermore, the control circuit 76 can comprise only the switch 81 and power source 78. Alternatively, the control circuit 76 can comprise a controller 72 that is adapted to vary the frequency or duty cycle of the pump 202 for selectively adjusting the mist flow rate through the nozzle 306. Varying the mist flow rate may be desirable, depending on the type of liquid 56 being distributed. For example, a relatively low flow rate of approximately 4 ml/min-10 ml/min may be desired when the liquid 56 comprises a deodorizer whereas a relatively higher flow rate of approximately 40 ml/min-200 ml/min rate may be desired to ensure efficacy of the treatment when the liquid 56 comprises a sanitizing agent. Accordingly, the liquid delivery system can be scaleable and can be configured with variable flow rate means adapted to accommodate a wide variety of liquids and applications. Any embodiments of the invention described herein can comprise a controller for varying the mist flow rate. Moreover, the specific flow rate ranges previously described are for exemplary purposes only and should not be construed as limiting the scope of the invention. Furthermore, the flow rate can be varied by alternative means commonly known in the liquid extraction floor cleaner art, such as by incorporating multiple liquid supply tanks or multiple, selectively engageable liquid flow paths, or separate pumps, for example, which are adapted to selectively increase the liquid and mist flow rate.

The operation of the mist generating system 300 is generally the same as for the mist generating system 200, except that liquid from the pump 202 is forced through the in-line filter 304, which is configured to trap any small debris to avoid clogging the atomizing nozzle 306 that is downstream of the filter 304. The liquid is forced into the atomizing nozzle 306 whereupon atomized mist droplets 96 are distributed through the outlet orifice 308 into the surrounding atmosphere. As previously described, the atomized mist droplets 96 can agglomerate airborne dust particles and drop them to the ground while optionally imparting various treatments to the cleaning surface such as deodorizing and sanitizing agents.

Figure 4:
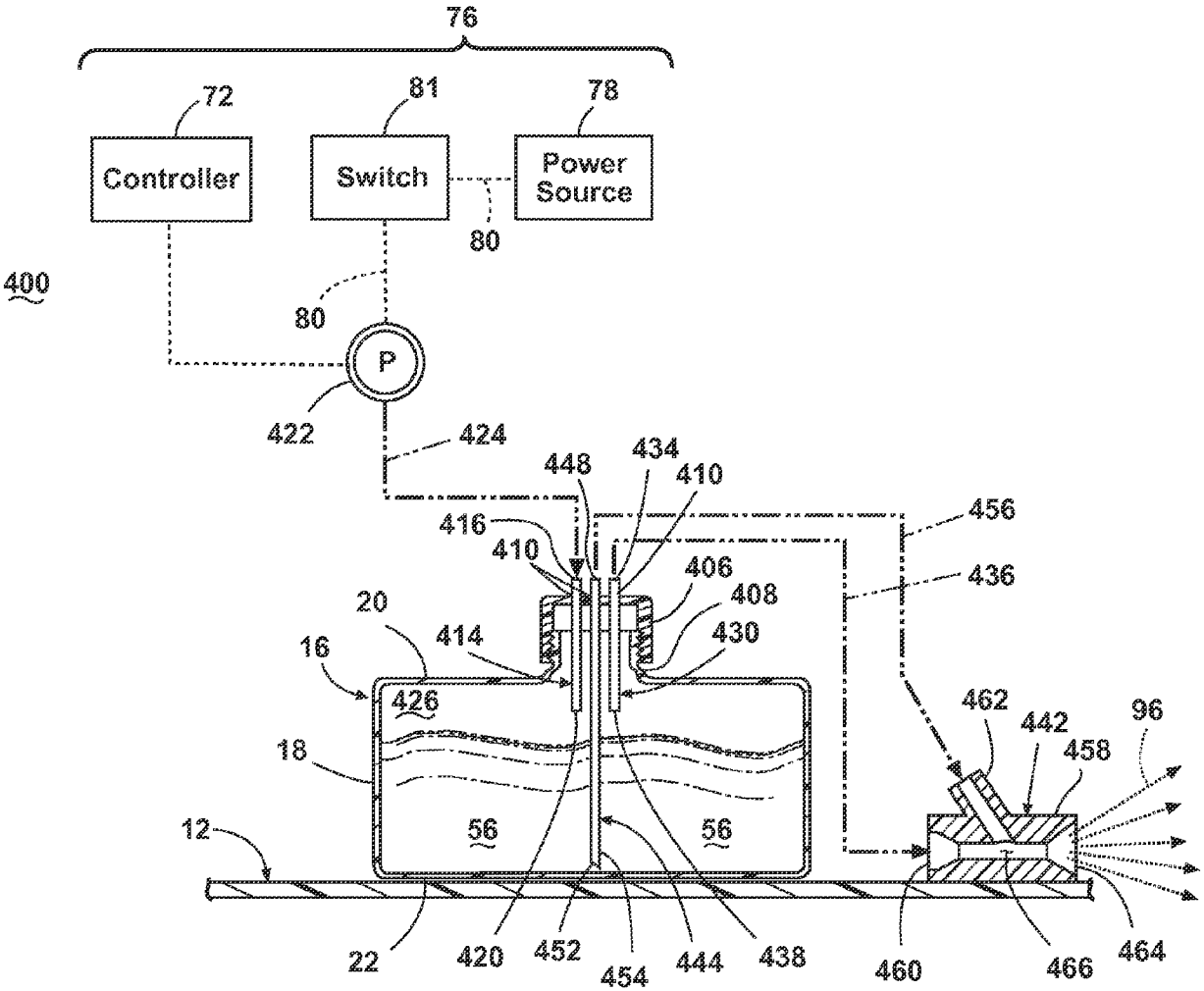
FIG. 4 is a schematic view of a modular mist generating system according to a fourth embodiment of the invention.

FIG. 4 shows a modular mist generating system 400 according to a fourth embodiment of the invention. In this embodiment, the tank 16 has a closed bottom wall 22 and an open neck 408 defining an opening formed in the top wall 20. A sealing cap 406 is adapted to be selectively secured and sealed to the open neck 408 via threads or bayonet fasteners, for example. The cap 406 comprises a plurality of holes 410 formed therethrough that are sized to sealably receive air and water tubing therethrough. A vertically-oriented air inlet tube 414 comprises an upper portion with an air inlet 416 that extends upwardly out of the cap 406. The air inlet tube 414 further comprises a lower portion with an air outlet 420 that is open to the interior of the tank 16. The air outlet 420 protrudes into the tank 16 to a depth slightly below the cap 406. The air inlet 416 is fluidly connected to an air pump 422 via an airpath 424 formed therebetween, such as by tubing or conduits (not shown). The air outlet 420 fluidly communicates with an air chamber 426 inside the tank 16 comprising the gas volume above the level of liquid 56 in the tank 16 commonly referred to as the "head space."

An air outlet tube 430 is mounted through the cap 406 and comprises an upper portion with an exhaust air outlet 434 that protrudes out of the cap 406 and a lower portion with an exhaust air inlet 438 that protrudes into the tank 16 to the same depth as the air inlet tube 414. The exhaust air inlet 438 fluidly communicates with the air chamber 426 and the exhaust air outlet 434 is fluidly connected to a downstream air-liquid atomizing spray nozzle 442 via an airpath 436 formed therebetween, such as by tubing or conduits (not shown).

A liquid outlet tube 444 is mounted through the cap 406 and comprises an upper portion with a liquid outlet 448 that protrudes out of the cap and a lower portion with a liquid inlet 452 that extends into the tank 16 and is adjacent to the bottom wall 22 of the tank 16. The liquid inlet 452 can comprise an angled tip 454 that prevents the tube 444 from sealing against the bottom wall 22 of the tank 16. The liquid outlet 448 is fluidly connected to the downstream air-liquid atomizing spray nozzle 442 via a liquid path 456 formed therebetween, such as by tubing or conduits (not shown).

The air-liquid atomizing spray nozzle 442 comprises a cylindrical body 458 with a coaxial, air inlet port 460 in communication with the air outlet tube 430 via airpath 436, a liquid inlet port 462 mounted to the cylindrical body 458 in communication with the liquid outlet tube 444 via the liquid path 456, and an atomized liquid outlet 464 at the distal end. The liquid inlet port 462 can be oriented perpendicular to or at an acute angle to the axis of the cylindrical body 458. The air and liquid inlet ports 460, 462 are fluidly connected to the liquid outlet port 464 via a mixing chamber 466 that is adapted swirl and mix the incoming air and liquid flow streams to generate an atomized air-liquid mist that can be distributed through the atomized liquid outlet 464. The air-liquid atomizing spray nozzle 442 can be mounted to the housing 12 in a variety of orientations depending on the desired mist trajectory and spray pattern. For example, the nozzle 442 can be mounted on the housing 12 so the outlet 464 points upwardly or horizontally relative to the housing 12. Alternatively, the nozzle 442 can be mounted above the housing 12 on a support structure and oriented with the outlet 464 pointing downwardly (not shown) towards the surface to be cleaned. In yet another configuration, the nozzle 442 can be adjustable relative to the housing 12. Furthermore, multiple nozzles can be fluidly connected to the air outlet tube 430 and liquid outlet tube 444 via conventional T-fittings or a manifold. At least one commonly known check valve (not shown) can be incorporated into the air and liquid paths 436, 456 upstream from the nozzle 442 to prevent liquid leakage through the outlet port 464 when the pressure in the air and liquid flow paths 436, 456 is below a predetermined threshold.

The air pump 422 is adapted to generate a pressurized airflow. The pump 422 is operably connected to power source 78 via conductor wires 80 and the power switch 81. The pump 422 can comprise a conventional piston pump or diaphragm pump design as is well-known in the art. Alternatively, the source of pressurized air can comprise pressure vessel with a selectively engageable outlet valve, such as a conventional CO2 cartridge or an aerosol container, for example.

In operation, a user removes the cap 406 and associated inlet air inlet tube 414, liquid outlet tube 444, and air outlet tube 430, and fills the tank 16 with liquid 56 to be atomized. The user secures the cap 406 and associated tubes 414, 444, 430 to the neck 408 and seats the tank 16 on the housing 12. Next, a user actuates the power switch 81 to energize the air pump 422. The air pump 422 generates airflow through the airpath 424, through the air inlet 416 and air inlet tube 414 and into the air chamber 426 through the air outlet 420. The incoming air pressurizes the air chamber 426 above the liquid 56 standing in the tank 16, which forces liquid and air through the liquid outlet tube 444 and air outlet tube 430 respectively. The positive pressure in the air chamber 426 forces liquid 56 through the angled tip 454 of the liquid inlet 452, upwardly through the liquid outlet tube 444, and out of the liquid outlet 448 into the liquid path 456 that is connected to the liquid inlet port 462 of the spray nozzle 442.

Pressurized air flows into the exhaust air inlet 438, through air outlet tube 430 that is spaced above the liquid 56 in the tank 16, and is discharged into the airpath 436 through the exhaust air outlet 434. The pressurized air flows into the air inlet 460 that is coaxial with the cylindrical body 458 of the spray nozzle 442. The pressurized air flows into the mixing chamber 466 and collides with the pressurized liquid simultaneously flowing into the mixing chamber 466 through the liquid inlet port 462. The pressurized liquid and air swirl and mix together inside the mixing chamber 466 and are distributed into the surrounding atmosphere through the atomized liquid outlet 468 as atomized, pressurized mist droplets 96. As previously described, the atomized mist droplets 96 can agglomerate airborne dust particles and drop them to the ground while optionally imparting various treatments to the cleaning surface.

Figure 5:
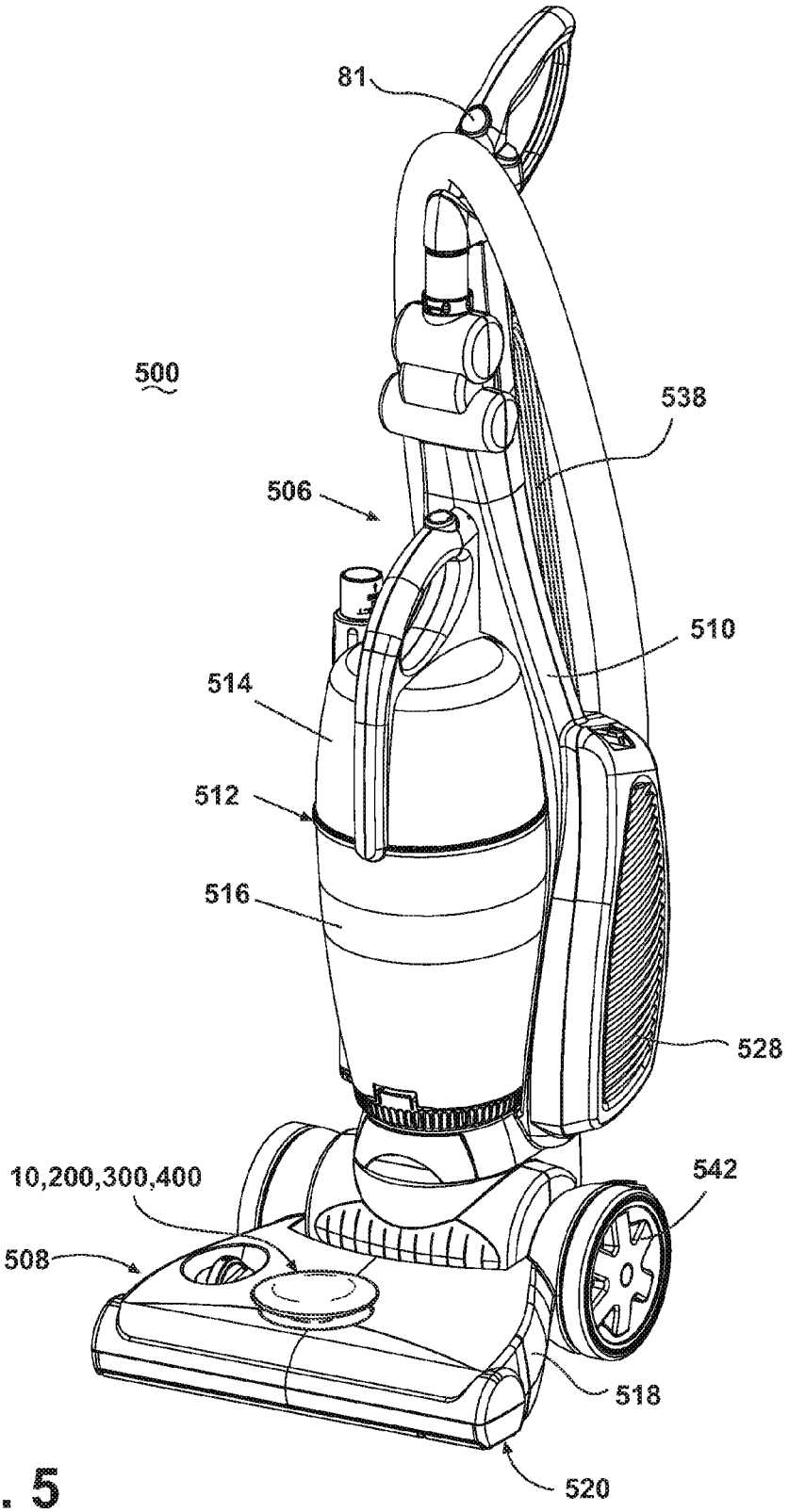
FIG. 5 is a partial perspective view of a modular mist generating system according to any embodiment of the invention mounted on a vacuum cleaner.

The modular mist generating systems 10, 200, 300, 400 disclosed herein can be adapted for mounting onto a wide variety of cleaning implements or devices. For example, as shown in FIG. 5, the modular mist generating system can be mounted onto a vacuum cleaner 500. A detailed description of a vacuum cleaner can be found in, for example, U.S. Pat. No. 7,811,349, which is incorporated herein by reference in its entirety. While not shown herein, the mist generating system 10, 200, 300, 400 can also be mounted onto a foot or on a body portion of a canister or portable hand vacuum cleaner. Moreover, the modular mist generating systems 10, 200, 300, 400 can be at least partially mounted within the housings of any of the cleaning devices described herein so that only the necessary components are exposed, such as the liquid supply tank and spray nozzles, for example.

As illustrated herein, the vacuum cleaner 500 is an upright vacuum cleaner 500 comprising an upright handle assembly 506 that is pivotally connected to a base assembly 508 for directing the base assembly 508 across the surface to be cleaned. The upright handle assembly 506 comprises a main body 510 housing a suction source (not shown) that is fluidly connected to a collection system 512 for separating and collecting contaminants from a working airstream for later disposal. In one conventional arrangement illustrated herein, the collection system 512 can include an integrally formed cyclone separator 514 and dirt cup 516 that is detachable from the handle assembly 506 as a module. The dirt cup 516 can be provided with a bottom-opening dirt door for contaminant disposal. In another conventional arrangement, the collection system 512 can include a cyclone separator for separating contaminants from a working airstream and a removable dirt cup for receiving and collecting the separated contaminants from the cyclone separator. In yet another conventional arrangement, the collection system 512 can include a filter bag. The vacuum cleaner 10 can also be provided with one or more additional filters upstream and/or downstream of the collection system 512.

The base assembly 508 further comprises a base housing 518 with a floor suction nozzle 520 located beneath a forward portion thereof. An agitator assembly (not shown) spans the suction nozzle opening and is rotatably supported therein and adapted to selectively agitate the surface to be cleaned. The agitator can be operably connected to a motor/blower assembly (not shown) as is commonly known in the art. The suction nozzle 520 is adapted to move along a surface to be cleaned and is rollably supported by one or more sets of wheels 542 secured to the base housing 518.

Figure 9:
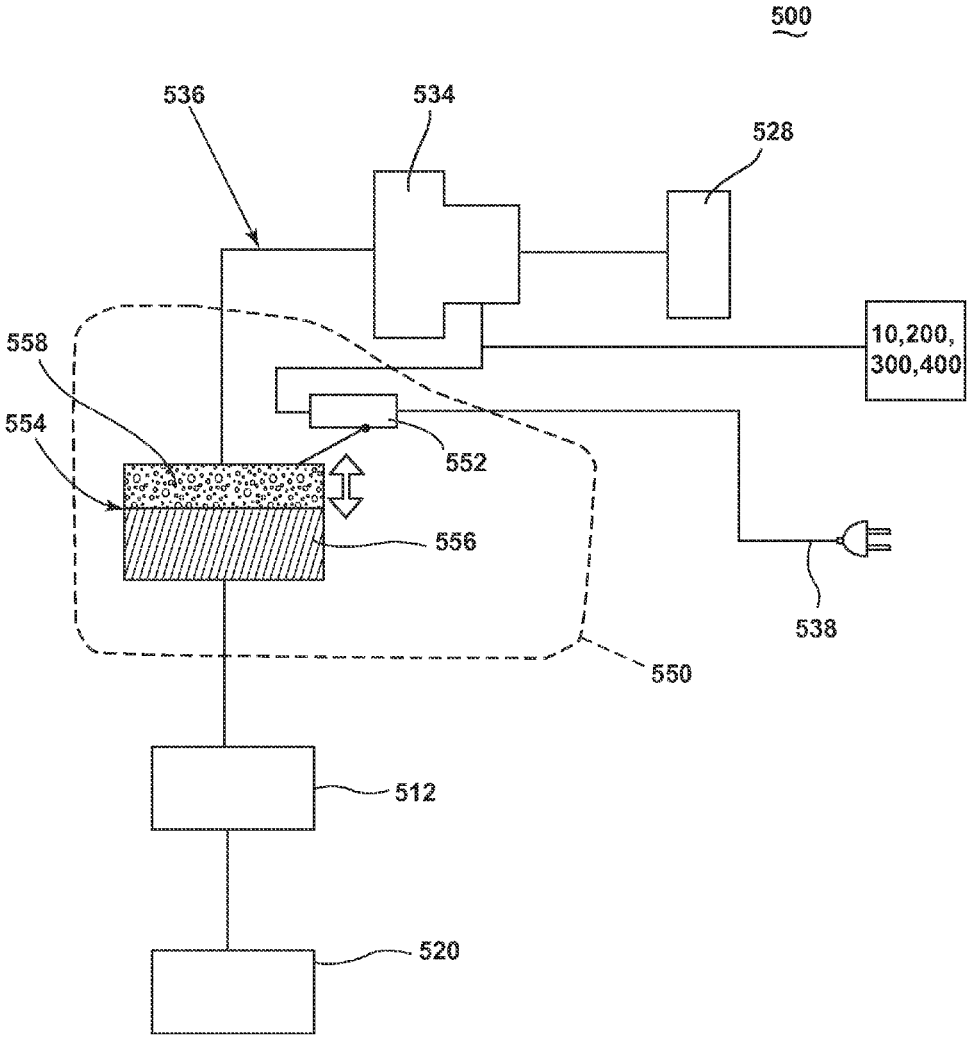
FIG. 9 is a schematic view of a vacuum cleaner shown in FIG. 5.

Referring to FIG. 9, which is a schematic view of the vacuum cleaner 500 shown in FIG. 5, the suction nozzle 520 is fluidly connected to the collection system 512 for collecting separated dust and debris. The collection system 512 is fluidly connected to a downstream suction source comprising a motor/blower assembly 534 that is adapted to generate a working airflow through the vacuum cleaner 500. The motor/blower assembly 534 is operably connected to a power circuit 536. The power circuit 536 can comprise a power cord 538 connected to a motor protection system 550 that is adapted to shut off electrical power to the motor/blower assembly 534 when a predetermined amount of liquid is ingested through the suction nozzle 520, into the working air path and downstream collection system 512. The power cord 538 can be selectively connected to a conventional residential power outlet to deliver electricity through the motor protection system 550 to the motor/blower assembly 534 and, optionally, to other electrical components connected to the power circuit 536, such as the modular mist generating system 10, 200, 300, 400. The suction source is fluidly connected to an exhaust chamber comprising a plurality of exhaust vents 528 for exhausting separated working air into ambient atmosphere.

In one embodiment, which is shown schematically in FIG. 9, the motor protection system 550 can comprise a micro-switch 552 mounted within the vacuum cleaner 500 in register with and adapted for selective actuation by an expandable pre-motor filter 554. The expandable pre-motor filter 554 detects moisture in air moving therethrough and can shut off the flow of potentially damaging moist air to the motor/blower assembly 534. The micro-switch 552 can be normally closed and is operably connected within the power circuit 536 for selectively controlling electricity to the motor/blower assembly 534 and, optionally, to the modular mist generating systems 10, 200, 300, 400 depending on the state of the expandable pre-motor filter 554.

The expandable pre-motor filter 554 can be fluidly connected within the working air path and mounted within a filter chamber (not shown) that is upstream from the motor/blower assembly 534 inlet and downstream from the collection system 512. The expandable pre-motor filter 554 can comprise a filter element 556 adjacent to an expansion element 558. The filter element 556 is adapted to filter fine particulates out of the working airstream prior to ingestion by the motor/blower assembly 534 and can comprise commonly known air filtration media such as open cell foam or high-efficiency particulate air (HEPA) filter media, for example.

The expansion element 558 is adapted to absorb and retain moisture. The expansion element 558 is further configured swell, expand, and actuate the micro-switch 552 when the expansion element 558 absorbs a quantity of moisture above a predetermined threshold. In one embodiment, the expansion element 558 can comprise superabsorbent polymer (SAP) material. For example, the expansion element 558 can comprise a non-woven SAP fiber material or a conventional particulate filter media coated with an SAP powder. The expansion element 558 can form a layer spanning the entire expandable pre-motor filter 554 as shown in FIG. 9, or a sleeve surrounding the filter element 556. Alternatively, the expansion element 558 can comprise an insert forming a localized area or discreet portion of the expandable pre-motor filter 554. Alternatively, the filter element 556 can be combined with the expansion element 558 in the same component that provides both particulate filtration and moisture expansion characteristics.

The modular mist generating system 10, 200, 300, 400 can be fixedly mounted to the base housing 518 as shown in FIG. 5, or to the main body 510 via conventional fasteners, such as screws for example, or via other conventional fastening methods such as snap-fit, for example. Optionally, the housing 12 of the mist generating system 10, 200, 300, 400 can be formed integrally in the base housing 518 or in the main body 510. The modular mist generating system 10, 200, 300, 400 is operably connected to the power circuit and power cord 538 and can be energized via the remote power switch 81 to operate simultaneously with the suction source. Optionally, the modular mist generating system 10, 200, 300, 400 can be connected to the power circuit via a separate power switch (not shown) so the system can be energized independently of the motor/blower assembly 534.

During operation, an operator connects the vacuum cleaner power cord 538 to a power source. The operator actuates the power switch 81 to energize the suction source and the modular mist generating system 10, 200, 300, 400. The suction source generates a working airflow through the separation and collection system 512 while simultaneously rotating the agitator. The rotating agitator lifts debris from the surface to be cleaned and entraining it into the working airflow. The debris is transported through the cyclone separator 514 and collected in the dirt cup 516 for later disposal. The working airflow passes through the expandable pre-motor filter 554, motor/blower assembly 534, whereupon the filtered working airflow is exhausted through exhaust vents 528 into the surrounding atmosphere. As the agitator spins, it disturbs the cleaning surface, thereby causing dust, debris, and other allergens trapped on the cleaning surface to float upwardly. The resulting airborne particulates pollute the ambient air surrounding the vacuum cleaner 500.

The modular mist generating system 10, 200, 300, 400 converts liquid 56 from the tank 16 into atomized mist droplets 96 as previously described. The atomized mist droplets 96 wet the dust and other airborne particles that are suspended in the air surrounding the base assembly 508, thus causing them to drop to the floor for ingestion by the vacuum cleaner 500 through the suction nozzle 520. The atomized mist thus creates a barrier that reduces operator exposure to undesirable airborne dust and allergens. Various additives, such as fragrances, detergents, peroxides, and other compositions as previously described herein may be added to the liquid for improved performance.

During use, however, it is possible that atomized mist droplets 96 will be ingested through the suction nozzle 520 together with the working airflow, into the working air path and downstream collection system 512. The motor protection system 550 is adapted to shut off electrical power to the motor/blower assembly 534 and, optionally, to the modular mist generating systems 10, 200, 300, 400 if a sufficient volume of moisture is ingested into the working air path.

As previously described, as the working air exits the separator 514, it flows through the expandable pre-motor filter 554. The filter element 556 traps any fine particulates remaining in the working airstream, whereas the expansion element 558 absorbs and retains any moisture contained in the working airflow, such as the entrained mist droplets 96. The expansion element 558 swells and expands as it absorbs the moisture. The expansion element 558 is configured to swell up and activate the motor protection system 550 when it absorbs a volume of moisture above a predetermined threshold. In that case, a surface of the expansion element 558 expands upwardly and contacts the micro-switch 552, which actuates the micro-switch 552 and opens the power circuit 536 connected to the motor/blower assembly 534 and, optionally, to the modular mist generating system 10, 200, 300, 400. An operator can reset the motor protection system 550 by replacing the entire spent expandable pre-motor filter 554 with an unused expandable pre-motor filter 554, or by merely replacing a portion thereof, provided the expansion element 558 can be replaced independently from the filter element 556.

Figure 6:
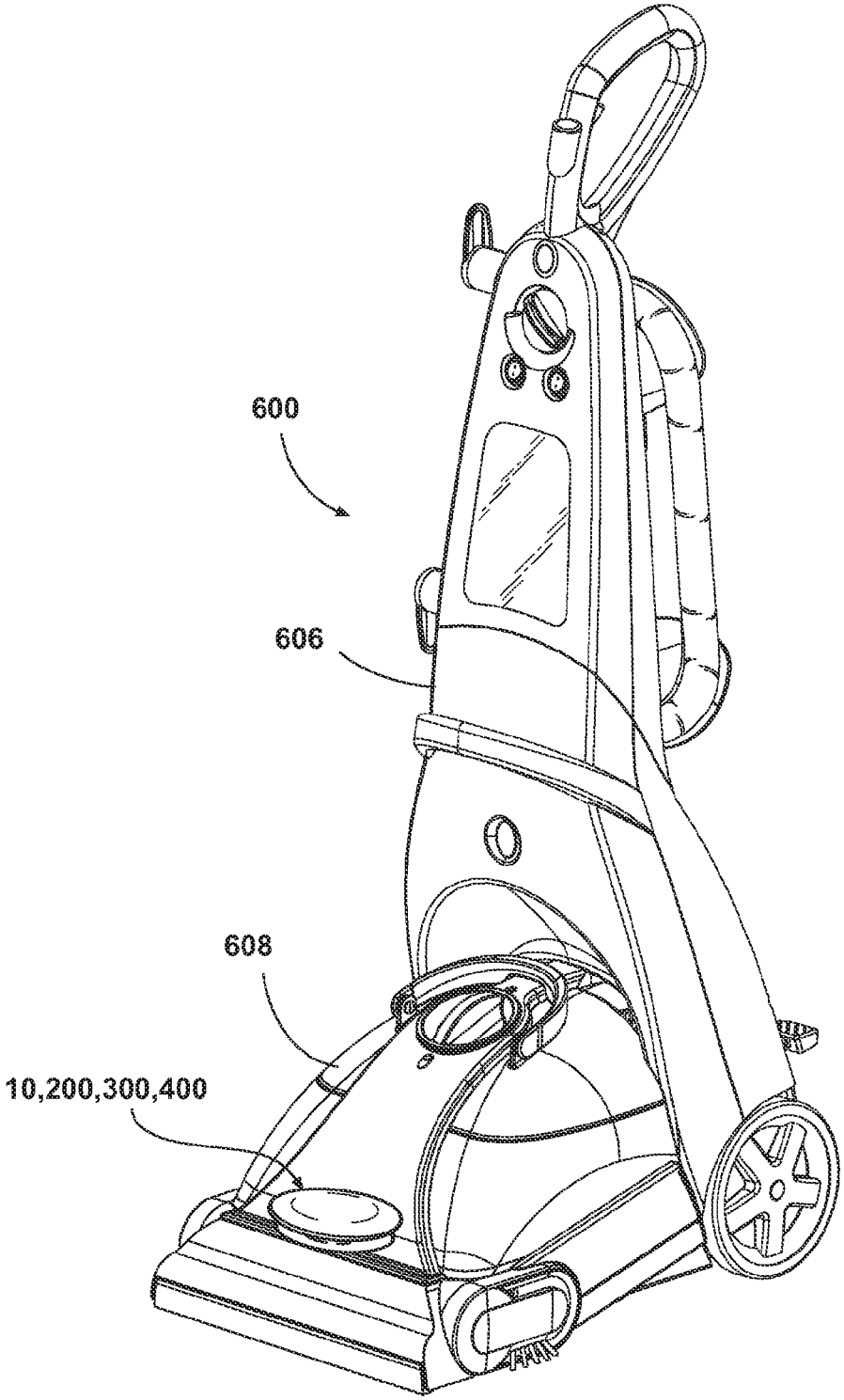
FIG. 6 is a perspective view of a modular mist generating system according to any embodiment of the invention mounted on an extraction cleaner.

FIG. 6 is a perspective view of the modular mist generating system 10, 200, 300, 400 mounted on an extraction cleaner 600. A representative example of a wet extraction cleaner can be found in U.S. Pat. No. 6,131,237, which is incorporated herein by reference in its entirety. As illustrated herein, the extraction cleaner 600 is an upright extraction cleaner 600 comprising an upright handle assembly 606 that is pivotally connected to a base assembly 608 for directing the base assembly 608 across the surface to be cleaned. As shown the mist generating system 10, 200, 300, 400 is mounted to the base assembly 608. The modular mist generating system 10, 200, 300, 400 can be mounted to the housing of the base assembly 608 in a substantially similar manner as previously described with regard to the vacuum cleaner 500 (FIG. 5). Alternatively, the mist generating system 10, 200, 300, 400 can be mounted to the handle assembly 606. While not shown herein, the mist generating system 10, 200, 300, 400 can also be mounted onto a foot or on a body portion of a canister or portable hand extraction cleaner.

Figure 7:
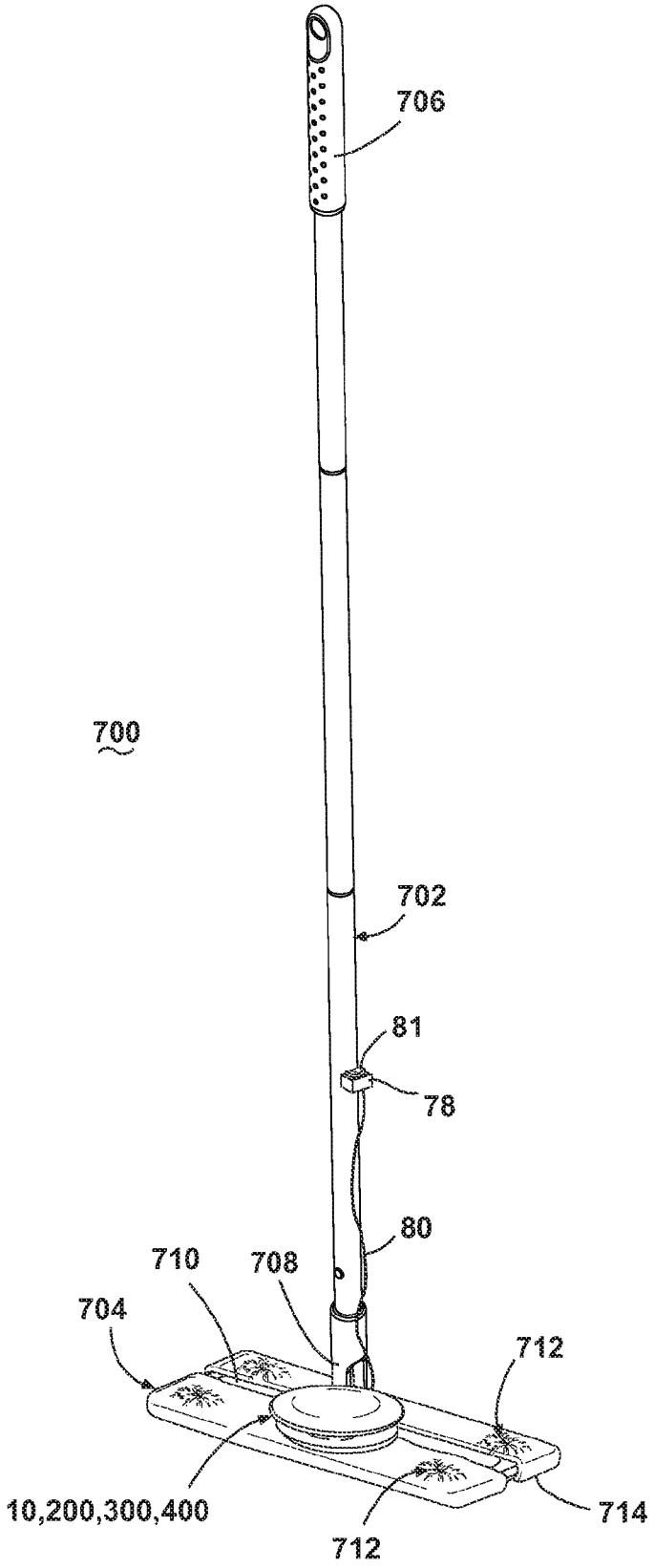
FIG. 7 is a perspective view of a modular mist generating system according to any embodiment of the invention mounted on a flat mop.

FIG. 7 is a perspective view of a modular mist generating system 10, 200, 300, 400 mounted on a flat mop 700. Representative examples of dust mops can be found in U.S. Pat. Nos. 3,778,860, and 6,484,346. The flat mop 700 comprises an upright stick handle 702 that is swivelably connected to a rectangular cleaning head 704 for maneuvering the cleaning head 704 across a surface to be cleaned. The handle 702 can comprise a grip 706 mounted on the distal end of the handle 702 comprising a resilient material such as an elastomeric material, for example. The handle 702 can be mounted to the cleaning head 704 by a conventional universal joint 708 or Cardan joint, which is well known in the art. The cleaning head 704 can further comprise a cushion (not shown) that is fixedly attached beneath the cleaning head 704 and adapted to frictionally engage a disposable dusting sheet or a cleaning cloth 714 as is well established in the art.

The cleaning head 704 comprises a housing 710 having at least one elastomeric, deformable sheet retention insert 712 in the top wall of the cleaning head 704. The sheet retention insert 712 can comprise radially extending slits in a spoke-like pattern that form deformable flaps for holding a portion of the cleaning cloth 714. Examples of such retainers are disclosed in U.S. Pat. No. 3,099,855 to Nash, and U.S. Pat. No. 7,013,528 to Parker et al., which are incorporated herein by reference in their entirety. The sheet or cleaning cloth 714 can be wrapped around the bottom of the cleaning head 704 and removably retained to the top of the housing 710 by at least one elastomeric, deformable mechanical sheet retention insert 712.

As shown in FIG. 7, the mist generating system 10, 200, 300, 400 can be mounted to the housing 710 as previously described. The power source 78 may be provided in the form of a rechargeable battery pack or replaceable battery mounted to either of the housing 710, cleaning head 704, or handle 702. Optionally, the power switch 81 can be provided on the handle 702.

In operation, a user actuates the power switch 81 to deliver power from the power source 78 to the modular mist generating system 10, 200, 300, 400. The modular mist generating system 10, 200, 300, 400 converts liquid 56 from the tank 16 into atomized mist droplets 96 as previously described. As the operator manipulates the grip 706 on the handle 702 to push and pull the cleaning head 704 across the surface to be cleaned, the atomized mist droplets 96 wet the dust and disturbed airborne particles that are suspended in the air surrounding the cleaning head 704, thus causing them to drop to the floor for facile collection by the sheet 714 or cleaning cloth mounted to the bottom of the cleaning head 704. The atomized mist thus creates a barrier that reduces operator exposure to undesirable airborne dust and allergens.

Figure 8:
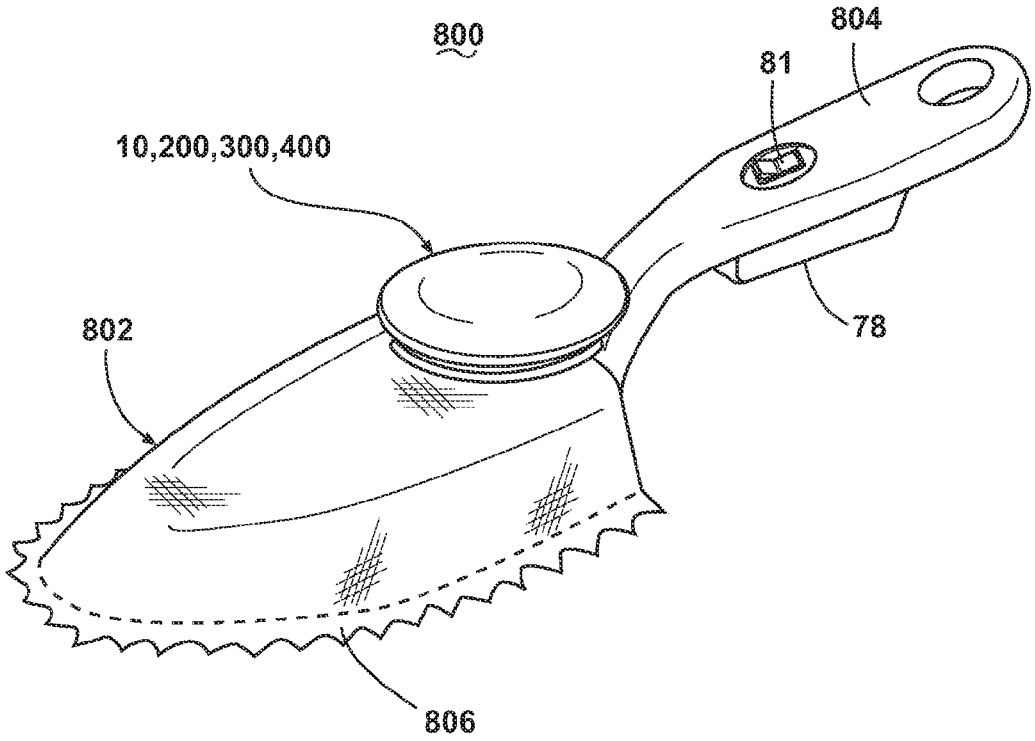
FIG. 8 is a perspective view of a modular mist generating system according to any embodiment of the invention mounted on a hand duster.

FIG. 8 is a perspective view of the modular mist generating system 10, 200, 300, 400 mounted on a hand duster 800. A representative example of a hand duster can be found in U.S. Pat. No. 6,047,435, which are incorporated by reference herein in their entirety. The duster 800 includes a head portion 802 connected to a handle 804. The head portion 802 can be configured to engage a disposable dusting sheet or a cleaning cloth 806. As shown, the modular mist generating system 10, 200, 300, 400 can be mounted to the head portion 802. The power source 78 may be provided in the form of a replaceable battery or rechargeable battery pack mounted to the handle 804. Optionally, the power switch 81 can be provided on the handle 804.

The term "modular", as used herein with respect to the mist generating system 10, 200, 300, 400 can refer to a self-contained unit that comprises substantially all components required to generate mist. The modular or self-contained nature of the mist generating system 10 allows variety, interchangeability and flexibility in use, and permits the system 10 to be used with a variety of different cleaning implements and mounted in different positions on the cleaning implement. Furthermore, the compact size of the mist generating system

10, 200, 300, 400 allows the system 10, 200, 300, 400 to be installed to a cleaning implement without adding a substantial amount of weight or displacing other working components.

While the invention has been specifically described in connection with certain specific embodiments thereof, it is to be understood that this is by way of illustration and not of limitation, and the scope of the appended claims should be construed as broadly as the prior art will permit. It is to be understood that the specific devices and processes illustrated in the attached drawings, and described in the specification are simply exemplary embodiments of the inventive concepts defined in the appended claims. Hence, specific dimensions and other physical characteristics relating to the embodiments disclosed herein are not to be considered as limiting, unless the claims expressly state otherwise.

What is claimed is:

1. A cleaning implement comprising:

a housing for movement over a surface to be cleaned; and a mist generating system mounted to the housing and comprising:

a tank for holding a supply of liquid, the tank having a tank inlet and a first tank outlet;

an atomizer nozzle in fluid communication with the first tank outlet and having a nozzle outlet for spraying a mist; and an air pump in fluid communication with the tank inlet for supplying air to the tank;

wherein, when the air pump has pressurized the supply of liquid in the tank, liquid is provided to the atomizer nozzle through the first tank outlet; and wherein the tank further comprises a second tank outlet in fluid communication with the atomizer nozzle for supplying air to the atomizer nozzle.

2. The cleaning implement from claim 1, wherein the atomizer nozzle comprises a liquid inlet port in fluid communication with the first tank outlet and an air inlet port in fluid communication with the second tank outlet, and the nozzle outlet is in fluid communication with the liquid and air inlet ports.

3. The cleaning implement from claim 2, wherein the atomizer nozzle comprises a mixing chamber in fluid communication with the liquid and air inlet ports.

4. The cleaning implement from claim 1, wherein the atomizer nozzle comprises an air-liquid mixing nozzle.

5. The cleaning implement from claim 1, wherein the tank inlet is defined by an inlet tube extending into a chamber defined by the tank, and the first tank outlet is defined by a first outlet tube extending into the chamber defined by the tank, wherein the first outlet tube is longer than the inlet tube.

6. The cleaning implement from claim 5, further comprising a second outlet tube extending into the chamber defined by the tank, wherein the first outlet tube is longer than the second outlet tube.

7. The cleaning implement from claim 1, further comprising a power switch operably connected to the air pump to selectively energize the air pump.

8. The cleaning implement from claim 1, wherein the cleaning implement comprises a dry vacuum cleaner, and the housing comprises a base assembly, a handle assembly pivotally connected to the base assembly for directing the base assembly over the surface to be cleaned, and a collection system for separating and collecting contaminants from a working airstream for later disposal, wherein the mist generating system is provided on at least one of the base and handle assembly.

9. The cleaning implement from claim 1, wherein the cleaning implement comprises an extraction cleaner, and the housing comprises a base assembly and a handle assembly pivotally connected to the base assembly for directing the base assembly over the surface to be cleaned, wherein the mist generating system is provided on at least one of the base and handle assembly.

10. The cleaning implement from claim 1, wherein the cleaning implement comprises a floor mop and the housing comprises a handle coupled with a cleaning head, and the mist generating system is provided on the cleaning head.

11. The cleaning implement from claim 1, wherein the cleaning implement comprises a hand-held dusting tool and the housing comprises a handle coupled with a head portion configured to mount a cleaning cloth.

12. The cleaning implement from claim 1, wherein the mist generating system is modular, and contains the tank, atomizer nozzle, and air pump in a common housing.

13. The cleaning implement from claim 1, wherein the cleaning implement comprises a dry vacuum cleaner further comprising a housing, and the mist generating system is at least partially mounted within the housing.

* * * * *